US005937262A

United States Patent [19]

Cho

[11] Patent Number: 5,937,262

[45] Date of Patent: Aug. 10, 1999

[54] DRIVING APPARATUS FOR A DUPLEX ELECTROPHOTOGRAPHIC DEVICE

[75] Inventor: Won-Mo Cho, Suwon, Rep. of Korea

[73] Assignee: SamSung Electronics Co., Ltd., Kyungki-do, Rep. of Korea

[21] Appl. No.: 09/144,077

[22] Filed: Aug. 31, 1998

[30] Foreign Application Priority Data

Aug. 30, 1997 [KR] Rep. of Korea ..... 97-43708

[51] Int. Cl.[6] ..... G03G 15/00

[52] U.S. Cl. ..... 399/401; 399/381

[58] Field of Search ..... 399/361, 364, 399/381, 397, 401, 405; 74/640; 271/184, 185, 186

[56] References Cited

U.S. PATENT DOCUMENTS

| | | | |
|---|---|---|---|
| 4,719,491 | 1/1988 | Katoh et al. . | |
| 4,743,975 | 5/1988 | Ijuin . | |
| 4,967,239 | 10/1990 | Sakakura . | |
| 5,148,220 | 9/1992 | Hilbert et al. . | |
| 5,155,603 | 10/1992 | Seok-Jae | 399/361 X |
| 5,273,273 | 12/1993 | Xydias | 271/186 |
| 5,415,391 | 5/1995 | Wong et al. | 271/186 X |
| 5,449,160 | 9/1995 | Hou et al. | 271/184 X |
| 5,584,589 | 12/1996 | Adkins et al. . | |
| 5,666,611 | 9/1997 | Chuan . | |
| 5,754,211 | 5/1998 | Chung . | |

*Primary Examiner*—Sandra Brase
*Attorney, Agent, or Firm*—Robert E. Bushnell, Esq.

[57] ABSTRACT

A duplex electrophotographic device has a driving apparatus that is constructed using only one motor to drive the various gears and rollers of the electrophotographic apparatus. A main gear is driven by the motor. The main gear is engaged with a set of gears that are mounted on a rod that is pivotally mounted inside of the housing of the electrophotographic device. A solenoid is attached to one end of the rod to move the set of gears between a first and a second position. When the set of gears is in a first position a first assembly is engaged with the set of gears. This assembly rotates a first plurality of rollers to transport a sheet of paper in a first direction. While the set of gears is in a second position, the set of gears is engaged with a second assembly that rotates both a first and second plurality of rollers in a second direction.

18 Claims, 3 Drawing Sheets

DRIVING APPARATUS FOR A DUPLEX ELECTROPHOTOGRAPHIC DEVICE

CLAIM OF PRIORITY

This application makes reference to, incorporates the same herein, and claims all rights accruing thereto under 35 U.S.C. §119 through my patent application entitled Duplex Print Driving Apparatus of Electrophotographic Processor earlier filed in the Korean Industrial Property Office on Aug. 30, 1997 and there duly assigned Serial No. 1997/43708.

BACKGROUND OF THE INVENTION

1. Field of the Invention

The present invention relates to a driving apparatus for an electrophotographic device and, more specifically, to a driving apparatus for the rollers and gears used in a duplex electrophotographic apparatus.

2. Background Art

A driving mechanism for an electrophotographic device may be constructed using a pickup roller to load a sheet of paper from a paper stack into the electrophotographic device. Rollers then convey the paper to a developing unit that is positioned along the paper transport path. An electrostatic latent image is formed on a photoconductive drum that is turned into a latent toner image by the developing unit. The latent toner image is transferred to the sheet of paper when the paper passes through the photoconductive drum and the transfer roller. The toner image is then fixed onto the sheet of paper when the sheet passes between a fixing roller and a heating roller. The sheet then passes by a set of delivery rollers that apply a turning force on the paper causing one end of the sheet of paper to revolve around an inversion guide. For simplex, or one sided, printing, the sheet of paper revolves around the inversion guide and is ejected from the electrophotographic device via a pair of exit rollers.

For duplex, or double sided, printing, the sheet of paper passes around the inversion guide after having an image formed on one side. However, when the sheet passes through the inversion guide, a sheet sensor detects the paper and causes the exit rollers to rotate in reverse. This causes the paper to be fed along the paper transport path in a reverse direction. The sheet of paper passes through rollers and is fed to pickup roller 11. The rollers are driven by numerous driving motors.

Some techniques used in electrophotographic processes are shown, for example, in U.S. Pat. No. 5,666,611 to Chuan entitled Image Scanner With One Lighting Unit and One Drive System for Scanning Either Reflective or Transparent Objects, U.S. Pat. No. 5,148,220 to Hilbert entitled Toning Station Drive for Image-Forming Apparatus, U.S. Pat. No. 4,719,491 to Katoh entitled Copier, U.S. Pat. No. 5,584,589 to Adkins entitled Graphics Printer Roller Transport Apparatus and Method, U.S. Pat. No. 5,754,211 to Chung entitled Image Forming Apparatus With a Single Driving Source, U.S. Pat. No. 4,967,239 to Sakakura entitled Printer Having a Reversible Motor and Separate Transmissions Systems, and U.S. Pat. No. 4,743,975 to Ijuin entitled Image Processing Apparatus.

The driving apparatus used in image forming devices of the contemporary art use additional driving motors to control the various rollers that need to be manipulated during the duplex printing process. Thus, the internal structure of the electrophotographic device becomes more complicated, and an individual controller must be added to the housing for each motor employed. Furthermore, the manufacturing cost increases when multiple motors are used by one electrophotographic device.

As such, I believe that it may be possible to improve on the contemporary art by providing a driving apparatus for an electrophotographic device that uses only one motor to drive the paper controlling rollers, that is more economical to produce, that is easier to assemble, and that is simpler to repair.

SUMMARY OF THE INVENTION

Accordingly, it is an object of the present invention to provide an improved driving apparatus for an electrophotographic device.

It is another object to provide a driving apparatus for an electrophotographic device that uses only one motor to drive the paper controlling rollers.

It is still another object to provide a driving apparatus for an electrophotographic device that is economical to produce.

It is still another object to provide a driving apparatus for an electrophotographic device that is easier to assemble.

It is still yet another object to provide a driving apparatus for an electrophotographic device that is simpler to repair.

It is a further object to provide a driving apparatus for an electrophotographic device that synchronizes the relative velocity of the rollers to increase the quality of the printing process.

These and other objects maybe achieved by providing a driving apparatus that is constructed using only one motor to drive the various gears and rollers of the electrophotographic apparatus. A main gear is driven by the motor. The main gear is engaged with a set of gears that are mounted on a rod that is pivotally mounted inside of the housing of the electrophotographic device. A solenoid is attached to one end of the rod to move the set of gears between a first and a second position. When the set of gears is in a first position a first assembly is engaged with the set of gears. This assembly rotates a first plurality of rollers to transport a sheet of paper in a first direction. While the set of gears is in a second position, the set of gears is engaged with a second assembly that rotates both a first and second plurality of rollers in a second direction.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE DRAWINGS

Figure 1:
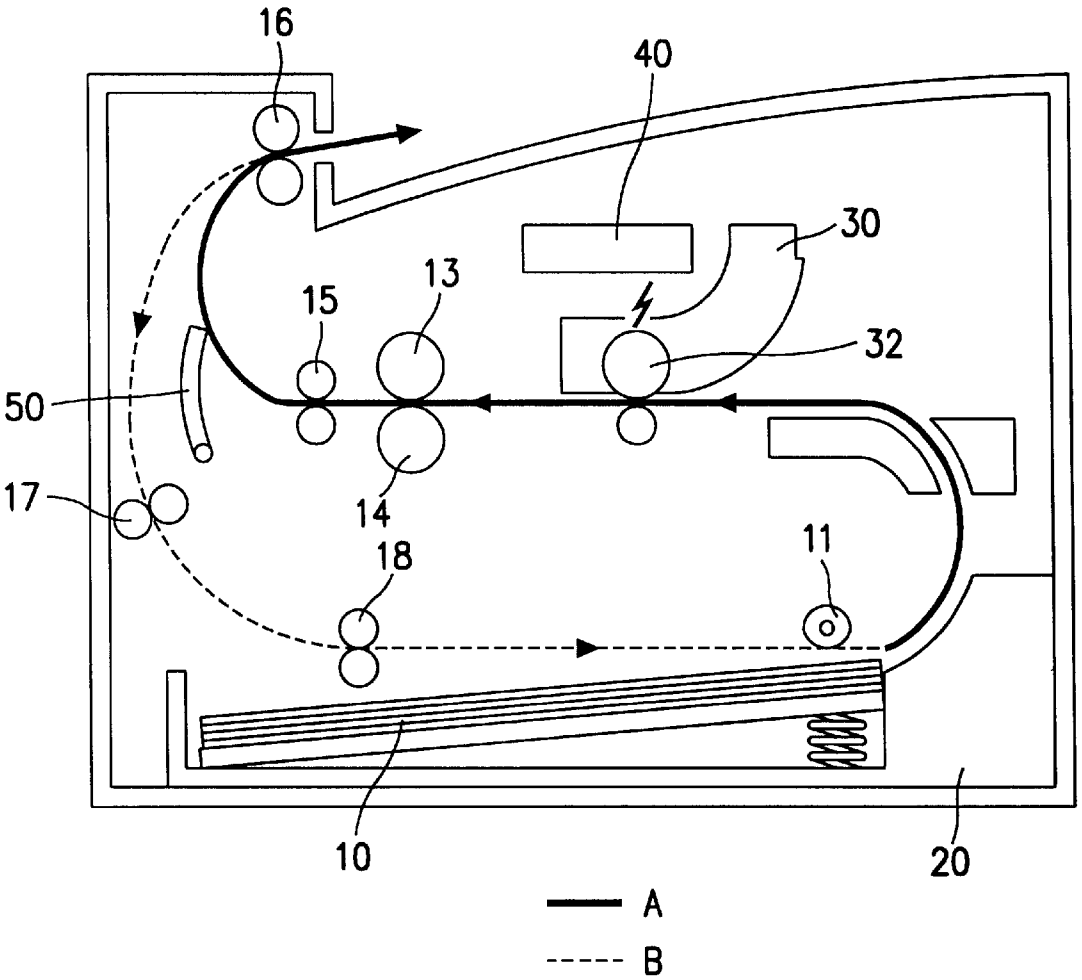
FIG. 1 is a schematic side view of a driving apparatus for an electrophotographic device.

Turning now to the drawings, FIG. 1 illustrates a driving mechanism for an electrophotographic device. Sheet of paper 10 is stacked in sheet cassette 20 to be picked up by pickup roller 11 and then fed to developing unit 30 along sheet feeding path "A". An electrostatic latent image is formed on photoconductive drum 32 of developing unit 30 by exposing unit 40. The electrostatic latent image on photoconductive drum 32 is developed into a latent toner image by the developing unit and then transferred onto the sheet of paper. The toner image is then fixed onto the paper as the sheet of paper passes between fixing roller 13 and heating roller 14. The sheet of paper passes between delivery rollers 15. The turning force of delivery rollers 15 causes one end of the paper to revolve around inversion guide 50. For simplex printing, the sheet revolves around inversion guide 50 and is ejected from the electrophotographic device via exit rollers 16.

Figure 2:
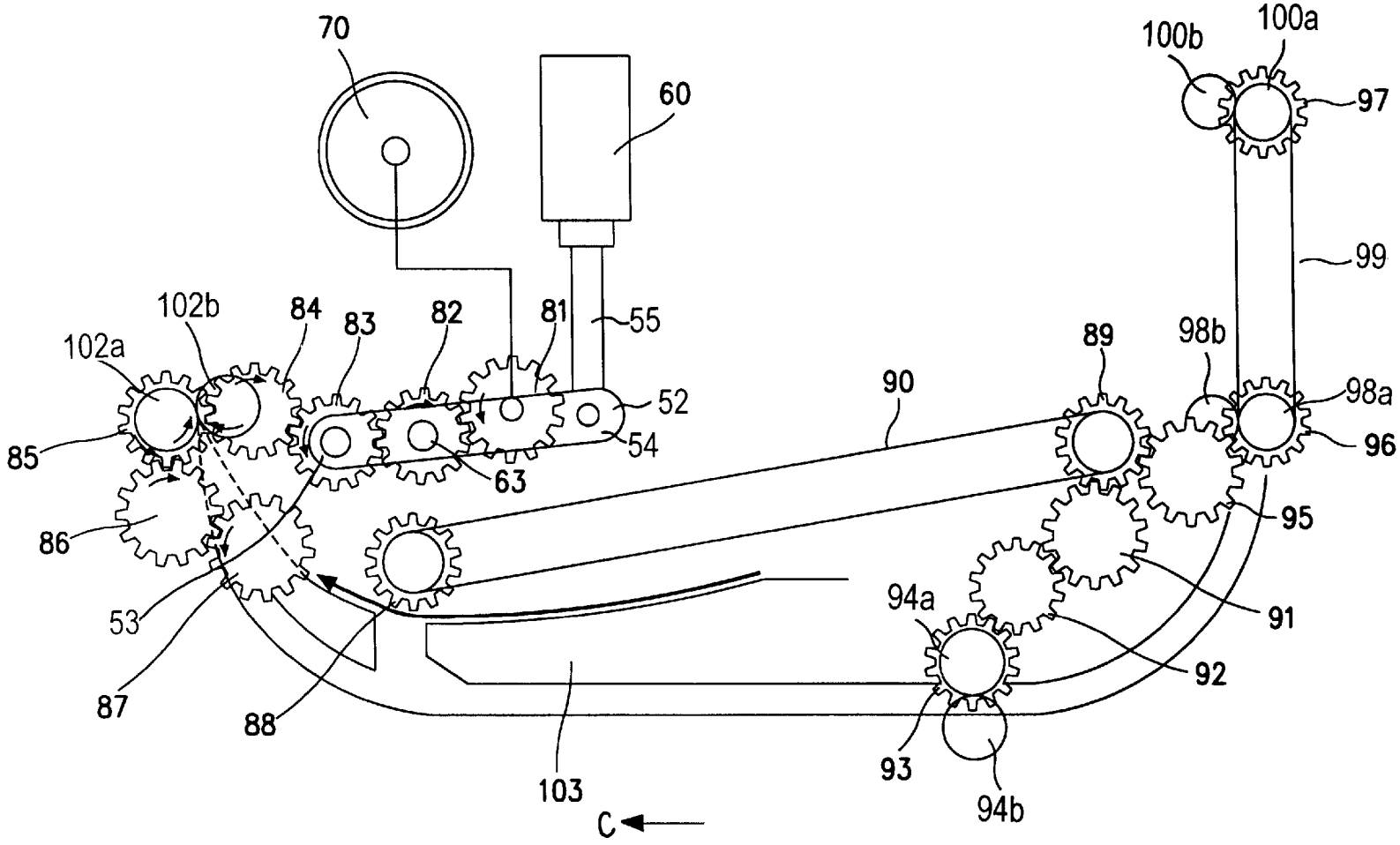
FIG. 2 is a schematic side view of a driving apparatus as constructed according to the principles of the present invention.

A driving apparatus as constructed according to the principles of the present invention is illustrated in FIG. 2. Main gear 81 is driven by main motor 70, that is the only motor used to drive the rollers and associated gears. A set of gears is engaged with the main gear. The set of gears may be constructed using interlocking gear 82, that is pivotally mounted on both rod 52 and hinge shaft 63, and hinge gear 83, that is attached to side 53 of rod 52. Solenoid 60 is attached on end 54 of rod 52 to rotatably move the set of gears between a first position and a second position. When the set of gears is in the first position, as shown in FIG. 2, the set of gears is engaged with the first assembly. The first assembly is comprised of first transfer gear 84, exit roller gear 85, and first and second exit rollers 102*a* and 102*b*. Hinge gear 83 causes first transfer gear 84 to rotate and thus, causes exit roller gear 85 to rotate. As exit roller gear 85 revolves in the same direction as hinge gear 83, second exit roller 102*b*, which is in contact with the outer surface of first exit roller 102*a*, is frictionally driven.

Figure 3:
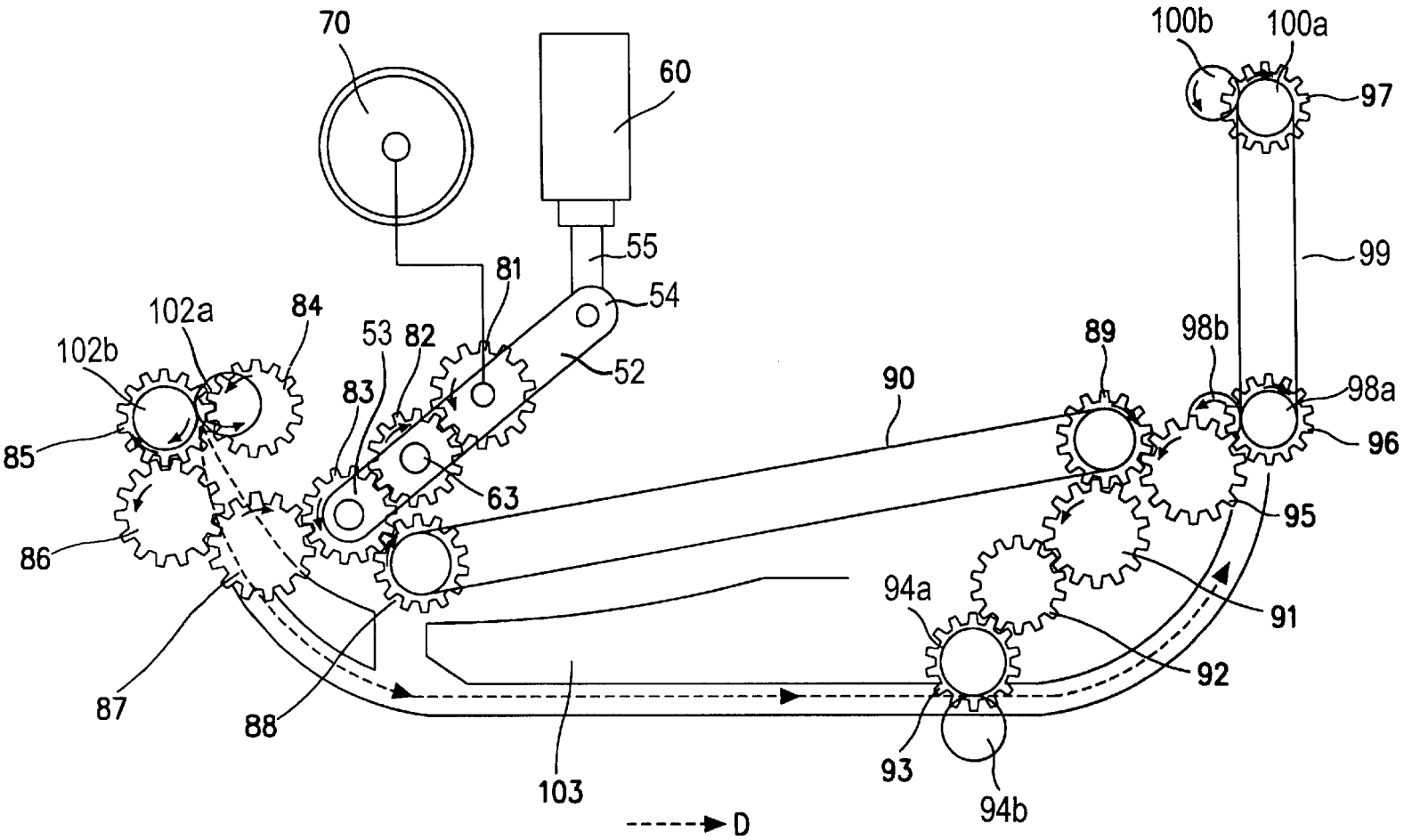
FIG. 3 is a schematic side view of the driving apparatus of FIG. 2 illustrating the apparatus during a duplex image forming process.

When the solenoid causes piston 55 to extend the set of gears is moved into the first position. This causes hinge gear 83 to engage first transfer gear 84. However, when piston 55 is retracted by the solenoid, then the set of gears is moved into a second position, as shown in FIG. 3. When the set of gears is in the second position, the set of gears are engaged with the second assembly.

As shown in FIG. 2, if a sheet of paper that has an image formed on a first side is fed along sheet guide 103 in a direction indicated by an arrow C, piston 55 protrudes and hinge gear 83 engages with first transfer gear 84. Thus, the turning force of main gear 81 revolving counterclockwise is transferred to exit roller gear 85 via interlocking gear 82, hinge gear 83 and first transfer gear 84. First exit roller 102*a* is linked to exit roller gear 85 that is revolving counterclockwise. Thus, the sheet of paper that has been fed along sheet guide 103 is ejected from the electrophotographic device by first and second exit rollers 102*a* and 102*b*.

FIG. 3 illustrates the operation of the drive apparatus of the present invention during the process of forming an image upon the second side of the sheet of paper. During this operation, the set of gears is in a second position that engages the set of gears with the second assembly. The second assembly may be comprised of first and second reverse transfer gears 87 and 88, first belt gear 88, belts 90 and 99, second belt gear 89, second and third transfer gears 91 and 92, conveying gear 93, and conveying rollers 94*a*, 94*b*, 98*a*, 98*b*, 100*a*, and 100*b*, and gears 96 and 97. When the set of gears is moved into the second position, first belt gear 88 engages hinge gear 83 and belt 90 is rotated to transmit power to second belt gear 89. Second belt gear 89 is linked to second transfer gear 91 that revolves with second belt gear 89 and further transmits the power to third transfer gear 92. Conveying gear 93 is driven by third transfer gear 92 and, in turn, rotates first conveying roller 94*a* and second conveying roller 94*b*. Third belt gear 95 is driven by second belt gear 89 and fourth belt gear 96 is driven by third belt gear 95. Third conveying rollers 98*a* is linked to fifth belt gear 97 via driving belt 99. A fifth convey roller 100*a* is linked to the fifth belt gear 97 and revolves in the same direction as the fifth belt gear 97. A sixth convey roller 100*b* is in contact with the outer surface of the fifth convey roller 100*a*.

As shown in FIG. 3, if the sheet which has an image formed on its front side is fed along the sheet guide 103 in order to form an image on its back side, the piston of the solenoid 60 is inserted into the interior of the solenoid 60. The rod, hinge plate, 52 turns about the hinge shaft 63, and the hinge gear 83 installed at one end of the rod, hinge plate, 52 engages simultaneously with the first belt gear 88 and the first reverse transfer gear 87. The turning force of the main gear 81 revolving counterclockwise by the driving of the main motor 70 is transferred to the interlocking gear 82, the hinge gear 83, the first reverse transfer gear 87, the second reverse transfer gear 86 and the exit roller gear 85. The first exit roller 102*a* linked to the exit roller gear 85 revolves clockwise. The sheet which has been fed along the sheet guide 103 is fed along a reverse sheet feeding path indicated by an arrow D by the first and second exit rollers 102*a* and 102*b*.

The turning force of the main gear 81 is also transferred to the first belt gear 88 via the interlocking gear 82 and the hinge gear 83, and again transferred to the fourth belt gear 96 via the second belt gear 89 and the third belt gear 95, thereby revolving the third convey roller 98*a* linked to the fourth belt gear 96 clockwise. Thereafter, the fifth belt gear 97 linked to the fourth belt gear 98 by the driving belt 99. The sheet of paper is fed along the sheet feeding path in the reverse direction and an image is formed on the sheet of paper.

After the sheet of paper has an image formed on both sides, the paper is fed along a sheet feeding path in a direction indicated by arrow C, as shown in FIG. 2. Solenoid 60 protrudes again, and hinge gear 83 engages with first transfer gear 84, part of the first assembly. Thus, the sheet of paper is ejected to the exterior of the electrophotographic device by first and second exit rollers 102*a* and 102*b*.

As described above, the duplex print driving apparatus of the electrophotographic device uses one main motor. Thus making it easier to synchronize the relative velocity of the rollers to ensure that the printing process avoids defects. Furthermore, the duplex print driving apparatus can be mounted in the electrophotographic device.

Although this preferred embodiment of the present invention has been disclosed for illustrative purposes, those skilled in the art will appreciate that various modifications, additions and substitutions are possible, without departing from the scope and spirit of the invention as disclosed in the accompanying claims. For example, it should be understood that numerous combinations of belts or gears can be used to attach the motor to the various rollers. It is also possible that other benefits or uses of the currently disclosed invention will become apparent over time.

What is claimed is:

1. An apparatus for driving a duplex electrophotographic device, comprising:

a housing containing an image forming means and a roller driving means limited to one motor;

said motor driving a set of gears;

said set of gears movable between a first position and a second position;

a first assembly mounted inside said housing for engaging said set of gears, while said set of gears is in said first position, to drive a first plurality of rollers that convey a sheet of paper in a first direction;

a second assembly mounted inside said housing for engaging said set of gears, while said set of gears is in said second position, to both drive said first plurality of rollers and drive a second plurality of rollers to convey said sheet of paper in a second direction; and an image being formable on a first side of said sheet of paper while said sheet of paper is being conveyed in said first direction and said image being formable on a second side of said sheet of paper while said sheet of paper is being conveyed in said second direction.

2. The apparatus of claim 1, with said set of gears further comprising:

an interlocking gear and an attached rod both pivotally mounted on a shaft, said interlocking gear engaged with said motor; and a hinge gear pivotally mounted on said shaft and engaged with said interlocking gear, said hinge gear selectively engaging one of said first assembly and said second assembly depending on a position of said set of gears.

3. The apparatus of claim 1, with said first assembly further comprising:

a transfer gear engageable with said set of gears; and an exit roller gear engaged with said transfer gear for turning said first plurality of rollers in said first direction while said set of gears is in said first position.

4. The apparatus of claim 3, with said second assembly further comprising:

a plurality of transfer gears engageable with said set of gears, while said set of gears is in said second position, to rotate said first plurality of rollers in said second direction; and means for transferring power from said set of gears, while said set of gears is in said second position, to said second plurality of rollers causing said second plurality of rollers to rotate in said second direction.

5. The apparatus of claim 4, with said means for transferring power further comprising:

a rotatable belt gear engageable with said set of gears, while said set of gears is in said second position, and attached to a belt; and said belt attached to a gear assembly for rotating said second plurality of rollers in said second direction.

6. The apparatus of claim 5, with said gear assembly further comprising:

a second belt gear attached to said belt; and a second plurality of transfer gears for transferring power from said second belt gear to said second plurality of rollers.

7. An apparatus for driving a duplex electrophotographic device, comprising:

a housing containing an image forming means and a roller driving means limited to one motor;

a main gear driven by said motor and engaging a set of gears;

said set of gears supported on a rod pivotally mounted to said housing;

a solenoid attached to a first end of said rod for moving said set of gears between a first position and a second position;

a first assembly mounted inside said housing for engaging said set of gears while said set of gears is in said first position, said first assembly driving a first plurality of rollers for conveying a sheet of paper in a first direction; and a second assembly mounted inside said housing for engaging said set of gears while said set of gears is in said second position, said second assembly driving both said first plurality of rollers and a second plurality of rollers for conveying said sheet of paper in a second direction.

8. The apparatus of claim 7, further comprised of said sheet of paper traveling in said first direction when an image is formed on a first side and traveling in said second direction when said image is formed on a second side.

9. The apparatus of claim 8, with said set of gears further comprising:

an interlocking gear and said rod both pivotally mounted on a shaft, said interlocking gear engaged with said main gear; and a hinge gear pivotally mounted on said shaft and engaged with said interlocking gear, said hinge gear selectively engaging one of said first assembly and said second assembly depending on a position of said set of gears.

10. The apparatus of claim 8, with said first assembly further comprising:

a transfer gear engageable with said set of gears; and an exit roller gear engaged with said transfer gear for turning said first plurality of rollers in said first direction while said set of gears is in said first position.

11. The apparatus of claim 10, with said second assembly further comprising:

a plurality of transfer gears engageable with said set of gears, while said set of gears is in said second position, to rotate said first plurality of rollers in said second direction; and means for transferring power from said set of gears, while said set of gears is in said second position, to said second plurality of rollers causing said second plurality of rollers to rotate in said second direction.

12. The apparatus of claim 11, with said means for transferring power further comprising:

a rotatable belt gear engageable with said set of gears, while said set of gears is in said second position, and attached to a belt; and said belt attached to a gear assembly for rotating said second plurality of rollers in said s second direction.

13. The apparatus of claim 12, with said gear assembly further comprising:

a second belt gear attached to said belt; and a second plurality of transfer gears for transferring power from said second belt gear to said second plurality of rollers.

14. An apparatus for driving a duplex electrophotographic device, comprising:

a housing containing an image forming means and a roller driving means limited to one motor;

said motor driving a set of gears;

said set of gears movable between a first position and a second position, said set of gears comprising:

an interlocking gear and an attached rod both pivotally mounted on a shaft, said interlocking gear engaged with said motor; and a hinge gear pivotally mounted on said shaft and engaged with said interlocking gear, said hinge gear selectively engaging one of a first assembly and a said second assembly depending on a position of said set of gears;

said first assembly mounted inside said housing for engaging said set of gears, while said set of gears is in said first position, to drive a first plurality of rollers that convey a sheet of paper in a first direction;

said second assembly mounted inside said housing for engaging said set of gears, while said set of gears is in said second position, to both drive said first plurality of rollers and drive a second plurality of rollers to convey said sheet of paper in a second direction; and an image being formable on a first side of said sheet of paper while said sheet of paper is being conveyed in said first direction and said image being formable on a second side of said sheet of paper while said sheet of paper is being conveyed in said second direction.

15. The apparatus of claim 14, with said first assembly further comprising:

a transfer gear engageable with said set of gears; and an exit roller gear engaged with said transfer gear for turning said first plurality of rollers in said first direction while said set of gears is in said first position.

16. The apparatus of claim 15, with said second assembly further comprising:

a plurality of transfer gears engageable with said set of gears, while said set of gears is in said second position, to rotate said first plurality of rollers in said second direction; and means for transferring power from said set of gears, while said set of gears is in said second position, to said second plurality of rollers causing said second plurality of rollers to rotate in said second direction.

17. The apparatus of claim 16, with said means for transferring power further comprising:

a rotatable belt gear engageable with said set of gears, while said set of gears is in said second position, and attached to a belt; and said belt attached to a gear assembly for rotating said second plurality of rollers in said second direction.

18. The apparatus of claim 17, with said gear assembly further comprising:

a second belt gear attached to said belt; and a second plurality of transfer gears for transferring power from said second belt gear to said second plurality of rollers.

* * * * *